United States Patent [19]

Maguire

[11] 4,258,489

[45] Mar. 31, 1981

[54] PHOTOGRAPH MOUNT WITH DUAL SUPPORT MEANS

[75] Inventor: Frederick J. Maguire, Braintree, Mass.

[73] Assignee: Charles D. Burnes Co., Inc., Boston, Mass.

[21] Appl. No.: 918,700

[22] Filed: Jun. 26, 1978

[51] Int. Cl.[3] ..... G09F 1/12

[52] U.S. Cl. ..... 40/152.1

[58] Field of Search ..... 40/152.1, 158, 152, 40/154

[56] References Cited

U.S. PATENT DOCUMENTS

| | | | |
|---|---|---|---|
| 1,842,473 | 1/1932 | Glassner | 40/152 |
| 1,971,923 | 8/1934 | Stern | 40/152 |
| 2,540,951 | 2/1951 | Kellems | 40/154 |
| 3,540,146 | 11/1970 | Watkins | 40/152.1 |
| 3,837,987 | 9/1974 | Williams et al. | 40/159 |

*Primary Examiner*—Gene Mancene
*Assistant Examiner*—Wenceslao J. Contreras
*Attorney, Agent, or Firm*—Robert T. Gammons

[57] ABSTRACT

A mount for photographs, pictures and the like comprising a rigid frame defining within its perimeter a window opening, said frame having front and back sides and at the back side one or more planar surfaces defining one or more recesses for receiving in superimposed relation window glass, a photograph or picture, a removable back panel, and a back board attached to the rearmost planar surface over the back panel. The frame is comprised of ceramic and the back board may optionally be provided with a hanger and/or support.

2 Claims, 17 Drawing Figures

PHOTOGRAPH MOUNT WITH DUAL SUPPORT MEANS

BACKGROUND OF INVENTION

Conventionally, picture and photograph mounts are made of lengths of wood which have to be mitered and joined or several pieces of cardboard which have to be die-cut and glued. The procedure, in either instance, is strictly a manual assembly operation which is time-consuming and is not susceptible of automation. The mount of this invention is designed especially to be made in part by blow-molding techniques which can be automated, thus minimizing the amount of manual work and assembly that is required and, at the same time, provides for a more durable and attractive surface finish with the possibility of various surface decorations.

SUMMARY OF INVENTION

As herein illustrated, the mount which is for pictures, photographs and the like comprises a frame defining within its perimeter a window opening bounded by front and back sides, said back side containing a recess bounded along one end and two sides by a first planar surface and along the other end by a second planar surface situated in a plane inwardly of the first planar surface such that there is a gap at said other end of the recess outwardly of the plane of the second planar surface, said recess being of a depth along said one end and sides to receive a window glass, a photo and a back panel, and said gap being of a depth such as to permit the back panel to be slid into and out of the recess in the plane of the back side of the photograph and a U-shaped back board adhesively attached to the first planar surface with parts of its ends and sides overlapping one end and the sides of the recess. The frame is comprised of a rigid molding of ceramic with the recesses and planar surfaces formed by the molding operation, the back panel and back board are comprised of cardboard, the back board is provided with a suitable hanger and the back panel with an easel leg. Alternatively, the frame has a first recess bounded along one end and two sides by a first planar surface and along its other end by a second planar surface situated in a plane inwardly of the first planar surface such that there is a gap at said other end of the first recess outwardly of the plane of the second planar surface and a second recess situated inwardly of the first recess bounded along all of its sides by said second planar surface, said second recess being adapted to receive the glass and photograph and said first recess being adapted to slidingly receive through its open end the back panel. In a third form, the back side of the frame has attached thereto an element defining a first planar surface along the ends and sides and a second element attached to the first element providing a second planar surface along one end and two sides which collectively define a recess of sufficient depth to receive a window glass, photograph and back panel having a gap at one end outwardly of the plane of the first planar surface of such depth as to permit the back panel to be slid into and out of the recess in the plane of the back side of the photograph.

The frames may be made by blow molding techniques with a glazed front side including decoration.

The invention will now be described in greater detail with reference to the accompanying drawings, wherein.

Figure 1:
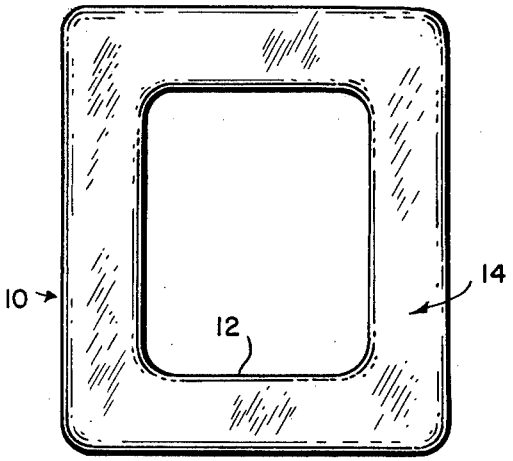
FIG. 1 is a plan view of the front side of the mount in one form.
Figure 2:
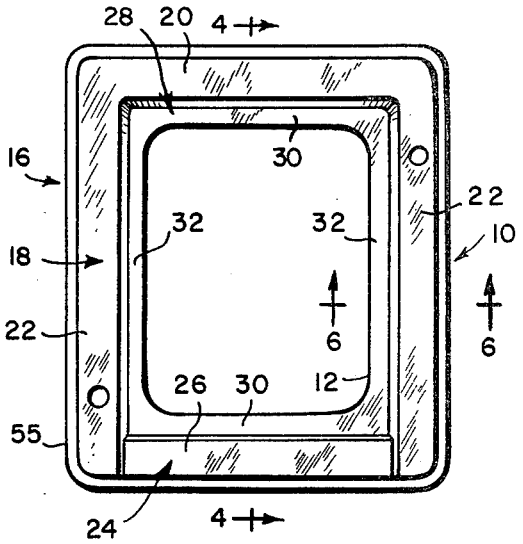
FIG. 2 is a plan view of the rear side of the frame with the window glass, picture, back panel and back board removed.

Referring to the drawings, FIGS. 1 to 7 inclusive, the mount comprises, in one form, a rigid frame member 10 containing a window opening 12 through which a picture or photograph removably mounted to the rear side of the frame may be displayed. The rigid frame 10 is comprised of ceramic and is made by blow-molding techniques and so is, to a large extent, interiorly hollow as indicated in cross section, FIGS. 4 and 5, which materially reduces its overall weight. The front surface 14 of the frame is glazed and suitably decorated, whereas the back side 16 is left unglazed.

Figure 3:
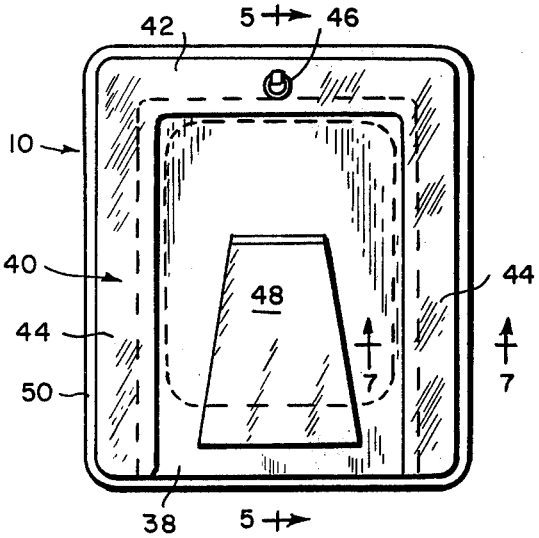
FIG. 3 is a plan view of the rear side with the window glass, picture, back panel and back board in place.
Figure 4:
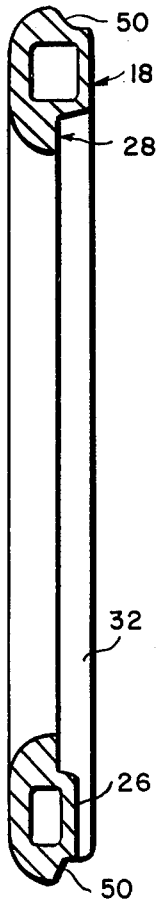
FIG. 4 is a section taken on the line 4—4 of FIG. 2.
Figure 5:
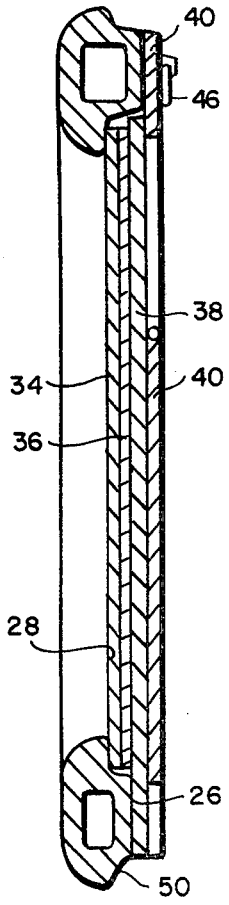
FIG. 5 is a section taken on the line 5—5 of FIG. 3.
Figure 6:
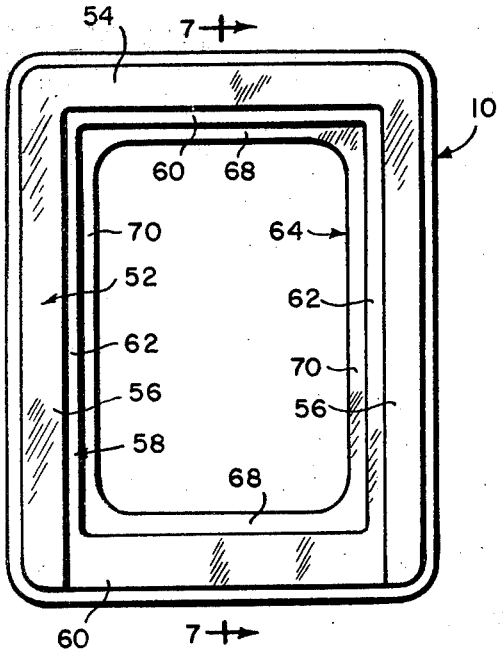
FIG. 6 is a plan view of the rear side of a modified form of the frame.
Figure 8:
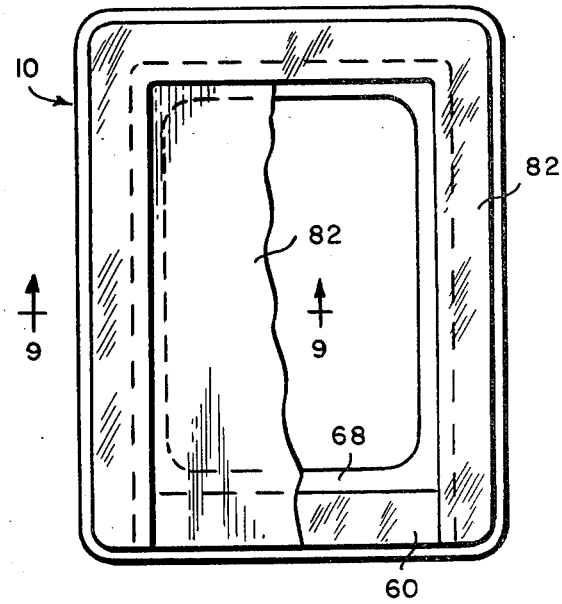
FIG. 8 is a plan view of the rear side of the modified form with the window glass, picture, back panel and back board in place.
Figure 7:
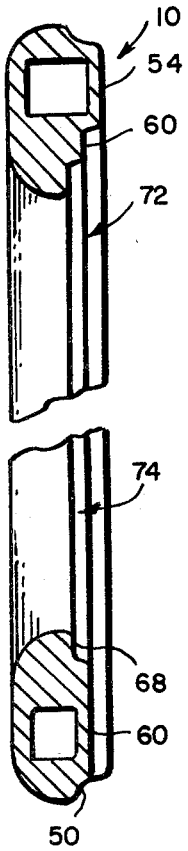
FIG. 7 is a section taken on the line 7—7 of FIG. 6.
Figure 10:
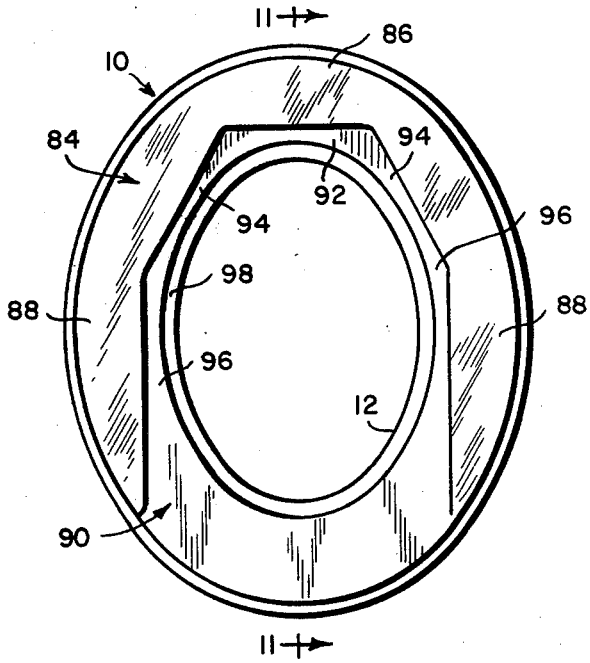
FIG. 10 is a plan view of the rear side of an oval frame.

The frame formed by the blow-molding technique is provided at its back side with a first planar surface 18 which extends transversely along the top of the frame and longitudinally along the sides of the frame having a transverse portion 20 and longitudinal portions 22—22. Within the first planar surface defined by the transverse and longitudinal portions 20, 22, there is a second planar portion 24 comprising a transverse portion 26, the plane of which is disposed inwardly of the planar portions 22—22. Inwardly of this second planar portion 24, there is a third planar portion 28 having transverse and longitudinal portions 30—30 and 32—32 situated in a plane inwardly of the plane of the portion 26. These latter surfaces bound the window opening 12. As thus formed, there is a relatively deep recess 32 at the back side of the frame which is sufficiently deep, as seen in FIGS. 4 and 5, to receive in superimposed relation window glass or other transparent material 34, a picture or photograph 36 to be displayed, and a back panel or easel board 38. The window glass, picture and back panel are removably retained within the recess 32 by a back board 40 of U-shaped comprising a transverse portion 42 and spaced, parallel, longitudinal portions 44—44 adhesively attached to the planar surface 18. The portions 42 and 44—44 are sufficiently wide so as to project inwardly over the top and side edges of the recess, as shown in FIGS. 3 and 5. The lower end of the back board 40 is left open, hence, the back panel or easel panel can be slidably withdrawn from beneath the back board to thus enable removing and/or replacing the window glass or the photograph or picture. The planar portion 26 prevents the window glass and picture from being withdrawn by the removal of the back panel.

For hanging the frame on a vertical surface, there is provided on the back board a ring 46 and for setting the frame up on a desk or table, there is provided an easel leg 48.

Desirably, the frame has peripherally thereof at the rear side a continuous groove 50 of arcuate section.

Figure 9:
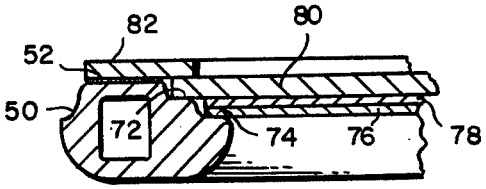
FIG. 9 is a section taken on the line 9—9 at FIG. 8.
Figure 11:
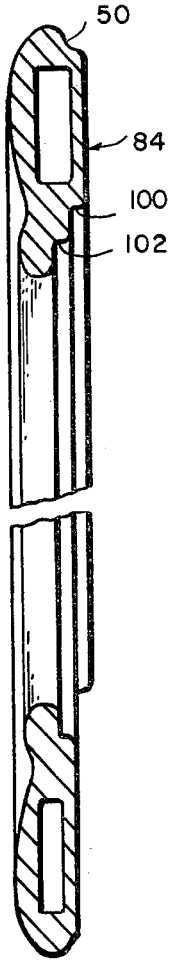
FIG. 11 is a section taken on the line 11—11 of FIG. 10.
Figure 12:
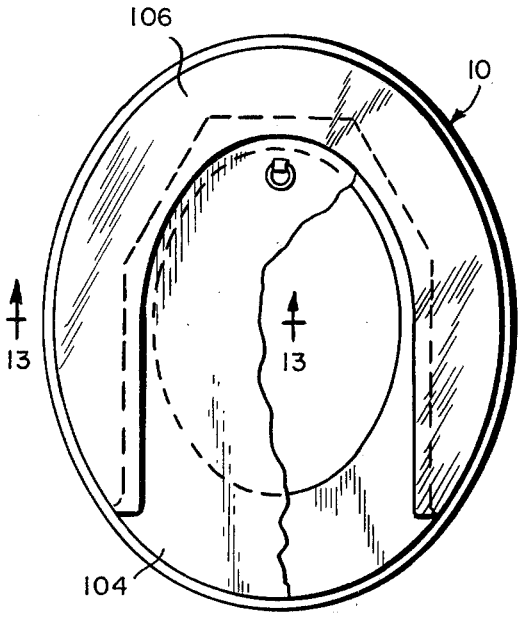
FIG. 12 is a plan view of the back side of the oval frame shown in FIG. 10.
Figure 14:
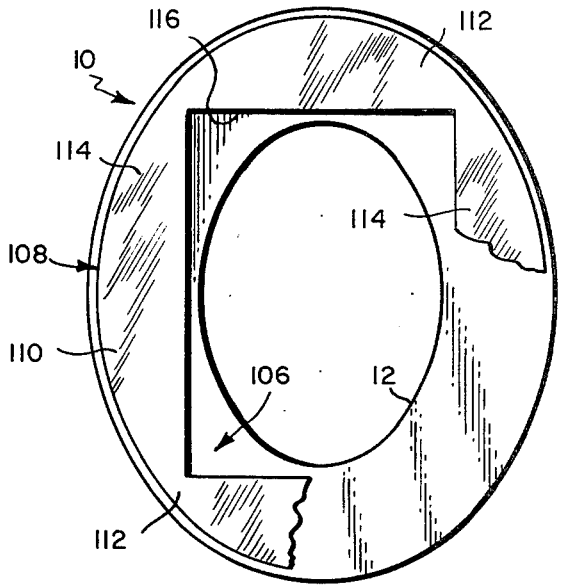
FIG. 14 is a plan view of the rear side of another form of the oval frame.
Figure 13:
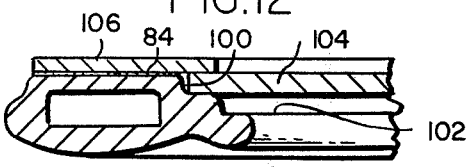
FIG. 13 is a section taken on the line 13—13 of FIG. 12.
Figure 15:
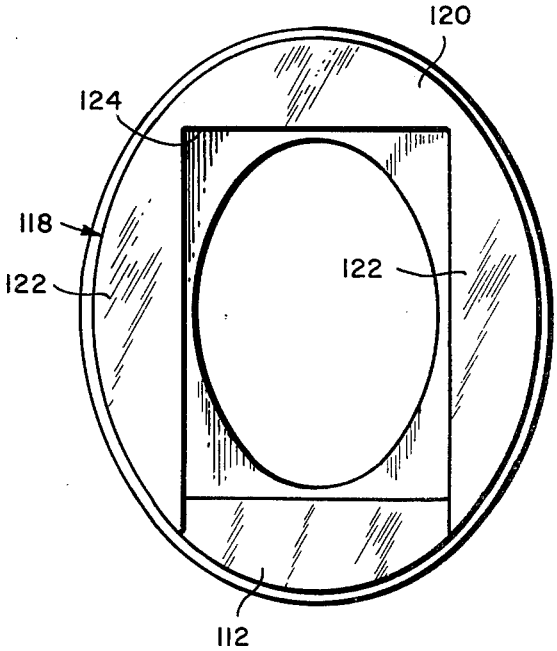
FIG. 15 is a view similar to FIG. 14 showing a spacer board applied to the rear side.
Figure 16:
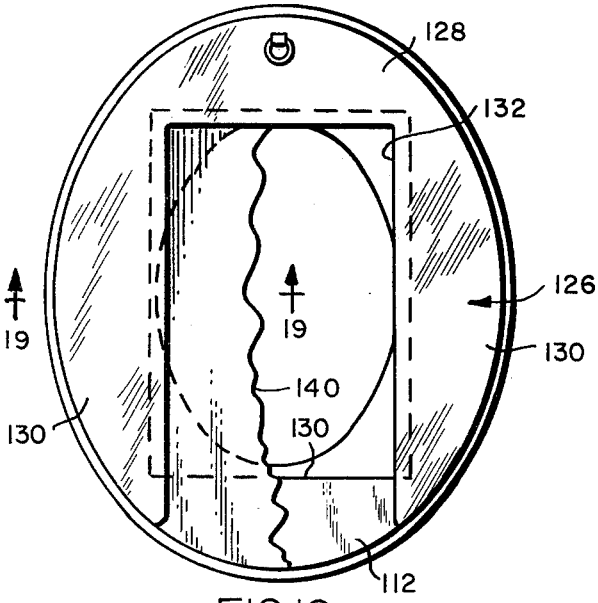
FIG. 16 is a view similar to FIG. 15 showing a back board applied to the spacer board.
Figure 17:
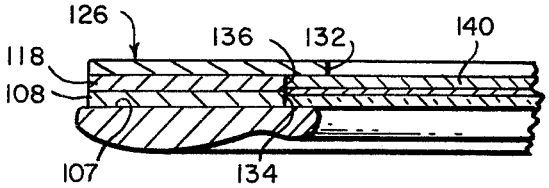
FIG. 17 is a section taken on the line 17—17 of FIG. 16.

A second form of the invention is illustrated in FIGS. 6 to 9. The front side of the frame 10 shown in FIGS. 6 to 9 is the same as that shown in FIGS. 1 to 5 inclusive. However, the back side differs in that there is a first planar surface 52 comprising a transverse portion 54 and longitudinal portions 56—56, a second planar surface 58 inwardly of the first planar surface comprising transverse portions 60—60 and longitudinal portions 62—62, and a third planar portion 64 inwardly of the second planar portion 58 comprising tranverse portions 68—68 and longitudinal portions 70—70. As thus formed, there is a first recess 72, FIGS. 6 and 7, and inwardly thereof a second recess 74. The recess 74 is of sufficient depth, as shown in FIG. 9, to receive the window glass 76 and a picture or photograph 78. The recess 72 which is of larger transverse and longitudinal dimensions than the recess 74 and is deep enough to hold a back panel or easel panel 80 so that the latter overlies the window glass and picture, thus holding them in place. A back board 82 is attached to the planar surface 52 over the back panel or easel board slidingly retaining the latter in place. Removal is permitted because the longitudinal planar surfaces 56—56 are open at the lower end of the frame. The back board 82 and the back panel 80 are like those described with reference to FIGS. 1 to 5 inclusive.

A third form of frame is shown in FIGS. 9 to 13 which is illustrated as oval in configuration rather than rectangular. The front side of the frame 10 is of the same formation as that of the frame described above. The back side has a first planar surface 84 comprising a transverse portion 86 and longitudinal portions 88—88, a second planar portion 90 comprising a transverse portion 92, diverging portions 94—94, and longitudinal portions 96—96. Within the second planar portion, there is a third planar portion 98 which extends all the way around the window opening 12. As thus formed, there is a first recess 100 and a second recess 102 inwardly of the first recess. The second recess is deep enough to receive the window glass and a picture or photograph and the first recess which is of greater width and length than the first recess is deep enough to receive the back panel or easel panel 104. The back panel 104 is configured to fit within the first recess so that its back surface is flush with the first planar surface and the back board 106 is horseshoe-shaped and is adapted to be glued to the first planar surface and is of such dimensions that its inner edge overlaps the edge of the first recess and, hence, of the back panel or easel board.

A final form of the invention is illustrated in FIGS. 14 to 17 wherein the frame 10 has a front surface which corresponds to that of the previously described frames and, in contrast to the previously described frame, a back side having a single planar surface 107. To provide for containing the window glass, the picture or photograph and the back panel or easel board, there is applied to the planar surface 107 a generally oval-shaped part 108, FIG. 14, having a planar surface 110 comprising a horizontal portion 112—112 and spaced, longitudinal portions 114—114 which, when applied to the planar surface 110, define a substantially rectangular opening 116. A spacer part 118, FIG. 15, which is of essentially the same oval configuration as the part 108, comprising a transverse portion 120 and longitudinal portions 122—122 defining a substantially rectangular opening 124 open at one end, is applied to the part 108. A back board 126 also of generally oval outside configuration having a horizontal part 128 and spaced parallel longitudinal parts 130—130 is glued to the spacer part 118 and provides a rectangular opening 132 open at one end. The part 108 provides a recess 134, FIG. 17, deep enough to receive the window glass, a photograph or picture and the part 118 provides a recess 136 deep enough to slidably receive the back panel 140. The back board 126 is of such dimensions that the inner edges thereof overlie the first and second recesses.

As has been previously stated, the frame of this invention in its various forms is especially designed to enable manufacture on a production line scale with a minimum amount of manual assembling operations and its principal component is the ceramic frame which is formed by blow-molding techniques of a ceramic and which can be glazed and decorated. The only parts required for completion of the frame, as illustrated in FIGS. 1 through 17, are the back panel and back board so that a minimum of assembly operations is required. The form of the invention illustrated in FIGS. 14 to 17, while requiring a spacer board, still has the advantage that the frame itself is capable of manufacture by molding techniques on a high production basis, thereby eliminating assembly of the frame itself.

It should be understood that the present disclosure is for the purpose of illustration only and includes all modifications or improvements which fall within the scope of the appended claims.

I claim:

1. A photographic mount comprising a rigid one-piece ceramic frame defining an opening of predetermined configuration, said frame having a front side within which the opening is centered, said opening constituting a window opening extending partway through the frame from the front side and the back side containing a major recess extending partway through from the back side, said major recess having a rearwardly-facing bottom surface situated intermediate the planes of the front and back sides completely bounding the window opening and a side wall surface also completely bounding the window opening which slopes from the back side toward the front side and inwardly toward the window opening, said back side bounding the major recess being substantially planar the major portion of the way around, but containing a minor recess in a portion of its circumference of lesser depth than the major recess which extends from the wall of the major recess in that portion in which the minor recess is situated to the outer edge of the frame and which has a planar surface situated in a plane between the planes of the back side and the rearwardly-facing bottom surface, said major recess being deep enough to receive a window glass, a photograph and a back panel so that the latter is flush with the planar surface of the minor recess and thus constrained from transverse movement therein, but free to be moved longitudinally therein and a U-shaped backboard adhesively secured to the planar back side of the frame having an outer edge coinciding with the outer edge of the back side and an inner edge bounding the major recess except for the portion thereof within which is located the minor recess, said inner edge overlapping the side wall except for the portion within which the minor recess is located and said minor recess providing an opening between its surface and the inner side of the U-shaped backboard for slidably receiving the back panel in the plane of the minor recess and the back side of the photograph situated in the major recess.

2. A photographic mount comprising a rigid one-piece hollow ceramic frame defining an opening of predetermined configuration, said frame having a front side within which the opening is centered, said opening constituting a window opening extending partway through the frame from the front side and the back side containing a major recess extending partway through from the back side, said major recess having a rearwardly-facing bottom surface situated intermediate the planes of the front and back sides completely bounding the window opening and a side wall surface also completely bounding the window opening which slopes from the back side toward the front side and inwardly toward the window opening, said back side bounding the major recess being substantially planar the major portion of the way around, but containing a minor recess in a portion of its circumference of lesser depth than the major recess which extends from the wall of the major recess in that portion in which the minor recess is situated to the outer edge of the frame and which has a planar surface situated in a plane between the planes of the back side and the rearwardly-facing bottom surface, said major recess being deep enough to receive a window glass, a photograph and a back panel so that the latter is flush with the planar surface of the minor recess and thus constrained from transverse movement therein, but free to be moved longitudinally therein and a U-shaped back board adhevisely secured to the planar back side of the frame having an outer edge coinciding with the outer edge of the back side and an inner edge bounding the major recess except for the portion thereof within which is located the minor recess, said inner edge overlapping the side wall except for the portion within which the minor recess is located and said minor recess providing an opening between its surface and the inner side of the U-shaped backboard for slidably receiving the back panel in the plane of the minor recess and the back side of the photograph situated in the major recess, a hanger attached to the backboard so as to enable suspending the mount and an easel leg attached to the back panel to enable setting the mount upright, said leg being so positioned that its distal end terminates short of the lower edge of the frame so as not to be exposed below the lower edge of the mount when suspended by means of the hanger.

* * * * *